US006834654B2

(12) United States Patent
Williams

(10) Patent No.: US 6,834,654 B2
(45) Date of Patent: Dec. 28, 2004

(54) SMOKELESS TOBACCO PRODUCT

(75) Inventor: Jonnie R. Williams, Manakin-Sabot, VA (US)

(73) Assignee: Regent Court Technologies, LLC, Chesterfield, MO (US)

( * ) Notice: Subject to any disclaimer, the term of this patent is extended or adjusted under 35 U.S.C. 154(b) by 0 days.

(21) Appl. No.: 10/134,689

(22) Filed: Apr. 30, 2002

(65) Prior Publication Data

US 2002/0162563 A1 Nov. 7, 2002

Related U.S. Application Data

(63) Continuation-in-part of application No. 09/845,249, filed on May 1, 2001, now Pat. No. 6,668,839.

(60) Provisional application No. 60/331,236, filed on Nov. 13, 2001, and provisional application No. 60/326,224, filed on Oct. 2, 2001.

(51) Int. Cl.[7] ..... A24B 15/00

(52) U.S. Cl. ..... 131/352; 131/347; 131/364

(58) Field of Search ..... 131/364, 347, 131/352, 359, 353

(56) References Cited

U.S. PATENT DOCUMENTS

| | | | | |
|---|---|---|---|---|
| 90,301 | A | | 5/1869 | Posada |
| 179,323 | A | | 6/1876 | Krackowizer |
| 2,478,473 | A | | 8/1949 | Eskew |
| 3,316,919 | A | | 5/1967 | Green et al. |
| 3,368,567 | A | | 2/1968 | Speer |
| 3,478,015 | A | | 11/1969 | Onishi et al. |
| 3,894,543 | A | | 7/1975 | Anderson et al. |
| 4,271,852 | A | | 6/1981 | Glock |
| 4,421,126 | A | | 12/1983 | Gellatly |
| 4,506,682 | A | | 3/1985 | Muller |
| 4,605,016 | A | | 8/1986 | Soga et al. |
| 4,802,498 | A | | 2/1989 | Ogren |
| 4,827,949 | A | | 5/1989 | Sunas |
| 4,907,605 | A | | 3/1990 | Ray et al. |
| 4,967,773 | A | | 11/1990 | Shaw |
| 4,991,599 | A | | 2/1991 | Tibbetts |
| 5,074,319 | A | | 12/1991 | White et al. |
| 5,135,753 | A | | 8/1992 | Baker et al. |
| 5,147,654 | A | | 9/1992 | Place et al. |
| 5,158,771 | A | | 10/1992 | Spindler et al. |
| 5,244,668 | A | | 9/1993 | Snipes |
| 5,326,563 | A | | 7/1994 | Spindler et al. |
| 5,362,496 | A | | 11/1994 | Baker et al. |
| 5,387,416 | A | * | 2/1995 | White et al. ..... 424/197.1 |
| 5,512,306 | A | | 4/1996 | Carlsson et al. |
| 5,525,351 | A | | 6/1996 | Dam |
| 5,549,906 | A | | 8/1996 | Santus |
| 5,593,684 | A | | 1/1997 | Baker et al. |
| 5,594,030 | A | | 1/1997 | Conte et al. |
| 5,599,554 | A | | 2/1997 | Majeti |
| 5,612,357 | A | | 3/1997 | Keenan et al. |
| 5,662,920 | A | | 9/1997 | Santus |
| 5,783,207 | A | | 7/1998 | Stanley et al. |
| 5,845,647 | A | | 12/1998 | O'Donnell, Jr. et al. |
| 6,135,121 | A | | 10/2000 | Williams |
| 6,164,287 | A | * | 12/2000 | White ..... 131/328 |
| 6,202,649 | B1 | | 3/2001 | Williams |
| 6,280,761 | B1 | | 8/2001 | Santus |
| 6,358,060 | B2 | | 3/2002 | Pinney et al. |

FOREIGN PATENT DOCUMENTS

| | | | |
|---|---|---|---|
| WO | WO 00/15056 | * | 3/2000 |

* cited by examiner

*Primary Examiner*—Dionne A. Walls
(74) *Attorney, Agent, or Firm*—Banner & Witcoff, Ltd.

(57) ABSTRACT

A smokeless tobacco product suitable for human consumption is prepared from powdered tobacco. In one aspect, the powdered tobacco has a collective content of N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB) which is 0.3 $\mu$g/g or less. In another aspect, a smokeless tobacco product comprises powdered tobacco and from about 0.5 to about 15 wt % peppermint, from about 0.5 to about 15 wt % spearmint, from about 0.5 to about 15 wt % menthol, and from about 0.5 to about 15 wt % eucalyptus. The powdered tobacco can be prepared by pulverizing cured tobacco or, alternatively, from an aqueous extract of tobacco.

20 Claims, No Drawings

SMOKELESS TOBACCO PRODUCT

CROSS REFERENCE TO RELATED APPLICATIONS

This application is a continuation-in-part of application Ser. No. 09/845,249, filed May 1, 2001, now U.S. Pat. No. 6,668,839, and claims priority under 35 U.S.C. § 119(e) to U.S. provisional application Ser. No. 60/331,236, filed Nov. 13, 2001, and to U.S. provisional application 60/326,224, filed Oct. 2, 2001.

FIELD OF THE INVENTION

The invention relates to tobacco products and, more particularly, to smokeless tobacco products.

BACKGROUND OF THE INVENTION

There are many oral delivery forms of tobacco. Such forms include chewing tobacco, chewing gum, bits, capsules, and tablets. Chewing tobacco utilizes chopped or shredded tobacco, which is placed in the mouth and ultimately removed from the mouth. Bits, tablets, and the like, are often designed to dissolve slowly in order to administer nicotine over a period of time. Such products are often obtained by chopping the tobacco plant or leaf and then extracting soluble components from the tobacco using a solvent. The resulting extract is dried and combined with other ingredients to form the products.

U.S. Pat. No. 3,368,567 describes a tablet having a tobacco concentrate and which is intended to be located in the mouth of the user. In preparing the tablet, nicotine and other active ingredients are extracted from cured tobacco that has been ground into fine particles. The tobacco is steeped in water and then concentrated mineral acid is added. The resulting liquid is applied to an absorbent, inert, edible base, to the extent that it constitutes less than 10% of the base. After the liquid is dried, the resultant material is compressed into a tablet.

U.S. Pat. No. 4,991,599 describes a fiberless tobacco product for smoking or chewing. The fiberless tobacco product is obtained by forming an aqueous extract of the tobacco. Cured tobacco leaves are preferably shredded or comminuted to minute particles, and boiling water or water vapor is passed through the particles to produce an aqueous, fiberless extract of tobacco. The aqueous extract is dried to produce a solid extract. The solid then is crushed into smokable or chewable particles.

U.S. Pat. No. 5,387,416 describes extracting cured tobacco leaves with water to form a liquid extract. The liquid extract is concentrated to a solids concentration of about 30% dissolved solids, which is then spray dried to form a spray dried powder. The powder is then dissolved and added to gelatin, for example, and processed to form a tobacco composition that can be placed in the cheek.

Other products utilize a package containing a tobacco product that is placed in the mouth. The tobacco diffuses through the package and the package is ultimately taken out of the mouth and thrown away. Such products include SNOOSE wherein tobacco is placed in a mesh pouch and placed in the mouth. U.S. Pat. No. 4,907,605 directed to using a water-insoluble material (could be similar to a tea-bag) to dispense nicotine in the mouth.

There is a developing market for smoking cessation aids. Most notably have been the transdermal or transmucosal devices to allow delivery of nicotine through the skin or mouth.

U.S. Pat. No. 5,512,306 describes a smoking cessation aid in the form of an inclusion complex formed between nicotine and a cyclo compound such as polysaccharide. U.S. Pat. No. 5,525,351 is directed to a saliva-soluble stimulant formed from a gel and nicotine, while U.S. Pat. No. 5,783,207 describes forming a compressed tablet containing a matrix material and nicotine whereby the compressed tablet is attached to a holder for insertion into the mouth.

U.S. Pat. Nos. 5,135,753; 5,362,496; and 5,593,684, are each directed to the combination of transdermal nicotine delivery along with transmucosal or buccal delivery of nicotine. The latter delivery may be in the form of lozenges, gum, tablets, or capsules.

However, these products suffer in that they deliver a product too high in nitrosamines, which are carcinogens believed to be formed predominantly during curing. The group of nitrosamines identified in tobacco products include tobacco-specific nitrosamines (TSNAs) such as N'-nitrosonornicotine (NNN), 4-(N-nitrosomethylamino)-1-(3-pyridyl)-1-butanone (i), N'-nitrosoanatabine (NAT) and N'-nitrosoanabasine (NAB). It is believed that nitrosamines may be derived from tobacco alkaloids, of which nicotine is the most prevalent. It has been postulated, according to one group of researchers, that nicotine is nitrosated to form NNN, NNK and/or 4-(N-methyl-N-nitrosamino)-4-(3-pyridyl) butanol (NNA) (Hoffman et al., "Formation, Occurrence, and Carcinogenicity of N-Nitrosamines in Tobacco Products" in O'Neill et al., N-Nitroso Compounds: Occurrence, Biological Effects and Relevance To Human Cancer, World Health Organization, 1984). Hecht et al., "Tobacco specific N-Nitrosamines Occurrence, Carcinogenicity, and Metabolism" Amer. Chem. Soc., 1979, postulated that NNN in unburned tobacco is at levels in the range of 0.3–9.0 ppm in cigarette tobacco, 3.0–45.3 ppm in cigar tobacco, 3.5–90.6 ppm in chewing tobacco, and 12.1–29.1 ppm in snuff. Up to 35 $\mu$g/g of NNK has been detected in tobacco, 0.2–8.3 $\mu$g/g in snuff products, and 0.1–0.5 mg/cig in cigarette smoke.

Generally, high nicotine and nitrosamine contents are found in lamina whereas stems contain lower levels of nicotine and nitrosamines. Stems typically have a nicotine content that is 50% or more lower than the nicotine content in lamina.

BRIEF SUMMARY OF THE INVENTION

According to one aspect, the present invention is directed to a smokeless tobacco product comprises powdered tobacco having a collective content of N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB) which is 0.3 $\mu$g/g or less.

According to another aspect of the invention, a smokeless tobacco product comprises powdered tobacco and from about 0.5 to about 15 wt % peppermint, from about 0.5 to about 15 wt % spearmint, from about 0.5 to about 15 wt % menthol, and from about 0.5 to about 15 wt % eucalyptus. Preferably, the powdered tobacco has a collective content of NNN, NNK, NAT and NAB which is 0.3 $\mu$g/g or less, as in the first embodiment.

The powdered tobacco can be prepared from pulverized tobacco stems, lamina, or both. Alternatively, the powdered tobacco can be prepared from an aqueous extract of tobacco stems, lamina, or both. The powdered tobacco, together with any optional flavorants or other ingredients, can be pressed into a bit or other form suitable for oral human consumption.

DETAILED DESCRIPTION OF THE INVENTION

The smokeless tobacco products described herein provide an alternative to cigarettes and traditional smokeless products. The smokeless tobacco product contains powdered tobacco and optionally other ingredients such as binders, eucalyptus, propolis, spearmint, menthol, and/or other flavorants. The product preferably contains primarily water-soluble (or saliva-soluble) components, permitting transdermal or transmucosal delivery of nicotine and other components. The powder is preferably milled fine enough so that even insoluble components can be easily swallowed. The product preferably has a very low nitrosamine content, preferably at food-safe levels.

In one preferred embodiment of the present invention, the smokeless tobacco product is a solid bit comprising powdered tobacco. The powdered tobacco may be produced from cured tobacco stems, lamina, or both (hereinafter collectively referred to as "tobacco material"). The relative proportion of tobacco material in the smokeless tobacco product depends on such factors as the particular composition of the tobacco leaf. The solid bit most often has from about 10% to about 80% of powdered tobacco by weight, more usually from about 25% to about 55% by weight.

Preferably, the cured tobacco material is pulverized, e.g. milled, to form a powdered tobacco. In this manner, the tobacco material is milled fine enough to produce an easily swallowed product. Alternatively, an extract of the tobacco material is dried to form a powder. In the extraction process, cured tobacco material is extracted with a solvent, typically water or steam. The resulting solution contains the water-soluble components of the tobacco, including nicotine. The solution is then dried and ground, as needed, to form a powdered tobacco.

The powdered tobacco may then be used to form a bit. Prior to forming the bit, however, the powdered tobacco may need to be processed to form larger particles such as by granulation or by rolling and grinding. Such processes provide particles, which are more readily formed into bits, and form bits, which do not disintegrate during handling and in the package. Moreover, the larger particles are easier to handle than the smaller particles and do not form the "dust" associated with small powder particles. Furthermore, the larger particles compress into bits more readily than powder particles. This allows for higher speed bit formulation and easier machining of the bits. In addition, using either granulation or rolling and pressing provides an even distribution of flavorants, coloring agents, and the like, throughout the final bit.

Granulation increases the particle size by adding a binder to the powder and allowing the powder to clump into larger particles. By using a fluid granulation process, for example, the powder clumps into fairly larger particles. The granulation process may also be used to add flavorants, such as eucalyptus or menthol, or other ingredients to the particles by including dissolved flavorants in the binder solution. Eucalyptus, for example, eliminates or reduces the bitterness of the final product.

Rolling under pressure presses the particles into a flake or a bark. The flake or bark is then ground to form particles, which are larger than the original powder particles. Prior to rolling, the powder may be mixed with other ingredients including binders and flavorants.

The powder or particles are then compressed to form a bit. The bit may be processed and packaged by any suitable means. The bit is placed in the mouth and allowed to dissolve, releasing the nicotine and other tobacco components. Any material that does not dissolve is easily swallowed along with the dissolved components. That is, for example, a bit formed from whole leaf pulverized tobacco, will disintegrate and dissolve in the mouth, such that any insoluble components are in the form of very small particles that are easily swallowed with the saliva.

The powdered tobacco of the smokeless tobacco product preferably is formed from cured tobacco stems, lamina, or both having very low TSNA content. Preferably, flue varieties of tobacco are used, i.e., Virginia flue. Tobacco stems generally have higher amounts of fibrous components than are present in lamina. Other differences exist. For example, stems typically have less bitterness than lamina. Lamina is easier to mill and has higher concentrations of soluble components.

First, tobacco is grown and harvested. The tobacco is cured and then removed from the curing barn. If only the stem or lamina is being used, the stem or lamina may be separated from the rest of the leaf either before or after curing. Preferably the stem or lamina is separated after curing.

The tobacco material preferably is cured using a process designed to obtain very low-TSNA cured tobacco. For example, a microwave process may be used to substantially prevent the formation of nitrosamines during curing. U.S. Pat. No. 5,803,081 and WO 98/05226 describe the use of microwaves to substantially prevent the formation of nitrosamines. U.S. Pat. No. 6,311,695 describes the use of high frequency electromagnetic energy (electron beam, gamma, etc.) applied to uncured tobacco to substantially prevent the formation of nitrosamines. Alternatively, tobacco can be cured in a controlled environment that avoids an anaerobic condition, as described in U.S. Pat. No. 6,202,649, to substantially prevent the formation of nitrosamines. U.S. Pat. No. 5,803,081, U.S. Pat. No. 6,202,649, and U.S. Pat. No. 6,311,695 are hereby incorporated by reference in their entirety.

In accordance with one preferred aspect of the invention, the powdered tobacco has a collective content of N'-nitrosonornicotine (NNN), 4-(N-nitrosomethylamino 1-(3-pyridyl)-1-butanone (NNK), N'-nitrosoanatabine (NAT) and N'-nitrosoanabasine (NAB) which is 0.3 $\mu$g/g or less, preferably is 0.2 $\mu$g/g or less, more preferably 0.1 $\mu$g/g or less, more preferably less than about 0.09 $\mu$g/g, more preferably less than about 0.07 $\mu$g/g, and even more preferably less than about 0.05 $\mu$g/g, 0.03 $\mu$g/g, 0.015 $\mu$g/g, 0.01 $\mu$g/g, or lower.

Preferably, the powdered tobacco has an NNK content of about 0.002 $\mu$g/g or less, more preferably about 0.001 $\mu$g/g or less, and even more preferably about 0.0005 $\mu$g/g or less. Preferably, the powdered tobacco has an NNN content of about 0.1 $\mu$g/g or less, more preferably about 0.05 $\mu$g/g or less, and even more preferably about 0.03 $\mu$g/g or less.

After curing, before or after milling or extracting, the tobacco material is preferably subjected to a sterilization technique. The sterilization technique typically irradiates the tobacco to destroy any microbes remaining on the tobacco in order to prevent or substantially prevent the further formation of nitrosamines. Any suitable radiation may be used such as, but not limited to, microwaves, gamma rays or electron beams. U.S. Pat. No. 6,311,695, discussed above, describes the use of electron beams.

The cured tobacco material is subjected to a process to form a powdered tobacco. The process may comprise extracting and drying, or a pulverizing process such as milling.

A preferred method of forming powdered tobacco is pulverizing the cured tobacco material into a powder. The cured tobacco material may be pulverized by any suitable process, preferably by milling. Preferably, the tobacco material is milled into particles having a particle size of about 50 to about 300 mesh, typically about 150 mesh.

The tobacco material may be chopped or powdered and then subjected to an extraction process with water or other aqueous solvent. With the exception of the pulp, substantially all of the components in tobacco are water-soluble, including components such as nicotine and anti-depressive components such as MAO inhibitors (e.g., nornicotine, anabasine, anatabine, etc.).

Methods for forming aqueous tobacco extracts are known in the art as described, for example, in U.S. Pat. No. 5,065,775. In general, tobacco material is contacted with an aqueous solution to extract soluble components. The time of contact will depend on such factors as the water to tobacco ratio and the temperature of the aqueous solution. The aqueous extract produced by contact with the water solution is then separated from the insoluble fibrous tobacco residue, which can be accomplished using conventional solid-liquid separation techniques. For example, squeezing, centrifugation, and filtration techniques may be employed. If necessary, the separated tobacco extract may then be treated to adjust soluble solids content.

More particularly, cured tobacco material is contacted with an aqueous extraction solvent. Contact can be performed in either a continuous or batch-wise manner. The mixture of tobacco material and extraction solvent can be agitated in order to enhance removal of water-soluble components from the tobacco material. The mixture is subjected to separation conditions (e.g., using a centrifuge) so as to provide an aqueous tobacco extract (i.e., a water-soluble tobacco extract within the extraction solvent), and a water-insoluble tobacco residue.

The aqueous extraction solvent is primarily water, normally at least about 90 wt % water, and can be essentially pure water such as deionized water, distilled water, or tap water. The extraction solvent can be a co-solvent mixture, such as a mixture of water and minor amounts of one or more solvents that are miscible therewith. An example of such a co-solvent mixture is a solvent containing 95 parts water and 5 parts ethanol per 100 parts by weight. The extraction solvent also may include substances such as pH adjusters (i.e., acids or bases) or pH buffers dissolved therein. For example, an aqueous solvent can have ammonium hydroxide or gaseous ammonia incorporated therein so as to provide a solvent having a pH of about 8 or more.

The amount of the tobacco material which is contacted with the extraction solvent can vary over a wide range and depends upon such factors as the type of solvent, the temperature at which the extraction is performed, the type or form of tobacco material which is extracted, the manner in which contact of the tobacco material and solvent is conducted, and the type of extraction process which is performed. Typically, for a batch-wise extraction, the weight of extraction solvent relative to the tobacco stems is greater than about 6:1, oftentimes greater than about 8:1 and in certain instances can be greater than about 12:1. The manner for contacting the tobacco material with the extraction solvent is not particularly critical, e.g., the tobacco material can be extracted in either a continuous or batch-wise manner. For example, the tobacco material can be extracted using a continuous counter-current extractor.

Tobacco material can be extracted in a batch-wise manner one or more times using the solvent. Normally, the weight of extract and solvent relative to the weight of tobacco material for each batch extraction ranges from about 6:1 to about 40:1, more often from about 15:1 to 25:1. The number of times that the tobacco stems is contacted batch-wise with the processed tobacco extract and solvent ranges from about 1 to about 8 times, more usually from about 3 to 5 times.

The tobacco material can be extracted continuously. Normally, the weight of aqueous solvent relative to the tobacco material with which it is contacted during a continuous extraction process is greater than about 40:1 and often is greater than about 50:1. The conditions under which the extraction is performed can vary. Typical temperatures range from about 5 to 75° C., more often from about 10 to 60° C. Alternatively, steam can be used to extract the soluble components, which can be recovered in a condenser. The solvent/tobacco material mixture can be agitated (e.g., stirred, shaken or otherwise mixed) in order to increase the rate at which extraction occurs.

Typically, for a batch-wise extraction, adequate extraction of components occurs in less than about 60 minutes, oftentimes in less than about 30 minutes. A wide variety of components can be extracted from the tobacco material. Water-soluble tobacco components that are extracted from tobacco material using a solvent having an aqueous character include alkaloids (e.g., nicotine), acids, salts, sugars, and the like. Water-soluble extracted tobacco components include many of the aroma-producing and flavorful substances of the tobacco material.

Then the solvent and tobacco extract are separated from the insoluble tobacco residue. The manner of separation can vary; however, it is convenient to employ conventional separation techniques involving the use of filters, centrifuges, screw presses, converging belts, rotating disk presses, and the like. The insoluble residue can be treated to remove additional solvent and tobacco extract therefrom.

The solvent and tobacco components extracted thereby optionally can be filtered to remove suspended insoluble particles. In some cases it may be desirable to adjust the pH of the aqueous tobacco extract. For example, as described in U.S. Pat. No. 5,065,775, pH of an aqueous tobacco extract can be raised to promote removal of basic compounds, lowered to promote removal of acidic compounds, or made neutral to promote removal of neutral compounds.

After extraction, the aqueous extract is dried into a powder by any suitable process. Preferably the extract is spray-dried to form a powder. Spray-drying techniques are disclosed, for example, in U.S. Pat. No. 5,387,416, the disclosure of which is hereby incorporated by reference in its entirety. The powder is optionally bleached and then dried. The powder generally has a particle size of below 80 mesh and typically between 100 and 300 mesh.

If the average particle size of the powder is smaller than 80 mesh, as is typically the result with the extraction process, and may be the result of the milling process, then the powder is subjected to a process to increase its particle size, to conglomerate particles to make larger particles or both, to an average size greater than 80 mesh, preferably to an average particle size of between 14 and 80 mesh. Any suitable process may be used to increase particle size. Preferably the powder is granulated, or rolled and ground. Granulating or rolling and grinding the powder forms particles, which are easier to handle, machine, and compress into bits than the powder.

The powder may be granulated in any suitable manner. A preferred method uses a fluid bed granulator. The powder is placed in a fluid bed product bowl in the chamber of the fluid bed granulator. Air or other suitable gas is introduced into the chamber to blow the powder around the chamber. A liquid solution containing at least a binder is introduced into the chamber in the form of a very fine mist. The particles blow around in the mist. The particles become coated and start to clump together to make discrete uniform particles. A second mist of a buffer solution may then be introduced. After spraying, the particles are dried to the desired moisture level and lubricants may be added to the particles.

The powder may contain only tobacco or may include other ingredients such as sweeteners, flavorants, coloring agents, and fillers. The liquid solution may simply contain a binder or may contain other ingredients in addition to the binder such as flavorants, coloring agents, sweeteners, and fillers. The lubricant may be a powder or a liquid. The lubricant may also contain other ingredients such as flavorants and sweeteners. The "other" ingredients may be distributed amongst the tobacco powder, binder solution and lubricant.

The rolling and grinding process passes the powder though a roller under high pressure. The powder forms flake (bark), which is then ground to form particles having a size larger than the original particle size, i.e. greater than 80 mesh.

Tobacco bits resulting from granulated or rolled and ground processes do not disintegrate but instead hold their form.

Preferably, the smokeless tobacco product includes eucalyptus in an amount effective to remove bitterness from the powdered tobacco. The eucalyptus may be provided, for example, by adding leaves of the eucalyptus tree to the tobacco prior to extraction, by adding eucalyptol to the powdered tobacco, or by adding eucalyptus extract to the binder solution used during the granulation process. Eucalyptol is a colorless oily liquid, $C_{10}H_{18}O$, derived from eucalyptus leaves.

In one embodiment of the invention, the smokeless tobacco product is a solid bit containing powdered tobacco and from about 0.5 to about 15 wt % peppermint, from about 0.5 to about 15 wt % spearmint, from about 0.5 to about 15 wt % menthol, and from about 0.5 to about 15 wt % eucalyptus, based on the total dry weight of the solid bit. This particular combination of components has been found to provide a product with highly desirable flavor and other consumption characteristics. Preferably, the solid bit contains from about 0.5 to about 10 wt % peppermint, from about 0.5 to about 10 wt % spearmint, from about 0.5 to about 10 wt % menthol, and from about 0.5 to about 10 wt % eucalyptus; and even more preferably the solid bit contains from about 1 to about 5 wt % peppermint, from about 1 to about 5 wt % spearmint, from about 1 to about 5 wt % menthol, and from about 1 to about 5 wt % eucalyptus. Preferably, the powdered tobacco has a collective content of NNN, NNK, NAT, and NAB which is 0.3 $\mu$g/g or less, as well as the other characteristics described above for the first embodiment.

In an alternative embodiment, propolis is combined with the powdered tobacco or to the binder solution instead of or in addition to eucalyptus. Like eucalyptus, propolis reduces the irritation that can be caused by nicotine in the mouth and enhances the flavor of the powdered tobacco while removing bitterness.

Propolis, also known as bee bread or hive dross, is a resinous substance found in beehives. Bees collect propolis from the outer surface of pollen granules. It has a greenish-brown sticky mass, with an aromatic odor. Its combination with alcohol yields a propolis wax. The propolis is extracted to remove the wax. The residue from the alcohol extraction is called propolis resin, yielding propolis balsam on extraction with hot petroleum ether. Propolis balsam has a hyacinth odor and is said to contain 10% cinnamyl alcohol. Attention is drawn to U.S. Pat. No. 5,845,647, hereby incorporated by reference in its entirety, which describes propolis and its use in tobacco-containing chewing gum and other tobacco products.

An aqueous solution of eucalyptus or propolis may be sprayed onto the tobacco leaf or stem prior to and/or after chopping. Alternatively, eucalyptus or propolis may be added to the liquid extractant after the tobacco is extracted with water or other aqueous solution. Powdered eucalyptus or propolis also may be combined with the powdered tobacco obtained by drying the extractant. Or the powder or extract may be added to the binder solution used during granulation.

Propolis can be added in an amount effective to provide a less bitter tobacco flavor or to enhance the pleasing tobacco flavor. For example, 1 to 10 ounces of propolis can be added per 100 pounds of tobacco or stems. When spraying a propolis solution on the tobacco stems, the solution typically contains about 10% to about 60% propolis by weight in alcohol.

Other ingredients may be added to the powder prior to forming into a bit. Such ingredients include, but are not limited to flavorants, such as menthol and spearmint, sweeteners, fillers, coloring agents, buffers, and lubricants. Such ingredients may be added to the powdered tobacco or, if using granulation process, to the binder solution. The examples demonstrate several suitable ways to introduce, combine, or coat the ingredients on the particles.

The relative amounts of such other components can vary over a wide range, depending on such factors as the particular tobacco used and consumer preferences. Typically, the amounts of individual components will range from about 0.5 wt % to about 15 wt %, more often from about 0.5 wt % to about 10 wt %, and even more often from about 1 wt % to about 5 wt %, based on the total weight of the powdered tobacco.

The smokeless tobacco product can be prepared by any suitable technique and is not limited by any particular method for its production. For example, powdered tobacco can be combined with excipients and a binder, and then granulated. The granulation can be dry-blended with the remaining ingredients, and compressed into a bit. The percent by weight of tobacco in the bit will vary depending on such factors as whether tobacco lamina is used. Since lamina has a higher concentration of nicotine than stems, generally lower amounts of tobacco are employed when lamina is used and higher amounts of tobacco are employed when only stems are used. The bit usually contains from about 10 to 80 wt % of powdered tobacco, preferably about 25 to 55 wt %. The weight of the bit can vary over a wide range, most often from about 75 mg to about 1,000 mg, more usually from about 150 mg to about 550 mg.

The user consumes the bit by placing it in the mouth. As the bit dissolves, the active tobacco components are dissolved in the saliva. Components in the powdered tobacco will transmucously absorb into the mouth or transdermally absorb into the skin or will be easily swallowed with the saliva.

Examples 1–7 illustrate granulating cured whole leaf tobacco that was pulverized into a powder. The resulting granules are compressed into tobacco bits using standard techniques.

EXAMPLE 1

Place tobacco powder and spray-dried flavors, including sweetener, in the product bowl of a fluid bed granulator (FBG). Form a solution of the binder. Place buffer ingredients into a solution so that it can be sprayed in the shortest amount of time. Premix ingredients in the fluid bed product bowl for approximately 3 minutes. Spray the binder solution into the granulator. After spraying the binder, spray the buffer solution into the granulator. Then dry to the desired moisture. Blend in lubricants.

EXAMPLE 2

Place tobacco powder and spray-dried flavors, including sweetener, in the product bowl for the FBG except for one third of the spearmint. Form a solution of the binder. Place the buffer ingredients into a solution so that it can be sprayed in the shortest amount of time. Premix ingredients in the fluid bed product bowl for 3 minutes. Spray the binder solution into the granulator. After spraying the binder, spray the buffer solution into the granulator. Dry to the desired moisture. Blend in lubricants and the remaining one-third spearmint.

EXAMPLE 3

Place tobacco powder into the product bowl. Form a solution of the binder. Place the buffer ingredients into a solution so that it can be sprayed in the shortest amount of time. Spray the binder solution into the granulator. After spraying the binder, spray the buffer solution into the granulator. Dry to desired moisture. Dry-blend in spray dried flavors, sweetener, and lubricants.

EXAMPLE 4

Place tobacco powder and excipients into the product bowl. Into an aqueous solution, add the spray-dried flavors and sweeteners plus any other excipients (e.g., coloring agents and binders) to form a sprayable slurry. Place the buffer ingredients into a solution so that it can be sprayed in the shortest amount of time. Spray the slurry into the granulator. After spraying the slurry, spray the buffer solution into the granulator. Dry to the desired moisture. Dry-blend in the lubricants.

EXAMPLE 5

Place tobacco powder and excipients into the product bowl. Into an aqueous solution, add all of the spray dried flavors and sweeteners plus any other excipients (e.g., coloring agents and binders) to form a sprayable slurry. Spray the slurry into the granulator. Dry to the desired moisture. Dry-blend in the lubricants.

EXAMPLE 6

Place tobacco powder and excipients into the product bowl. Put binder to be sprayed and the buffers into a combined or separate solution. Put the combination of all the flavorants into a separate container and dilute so that they can be sprayed. Spray the binder and buffer solution into the granulator. Dry to desired moisture. Spray the flavorants into the granulator. Dry-blend in the lubricants.

EXAMPLE 7

Tobacco powder was combined with excipients in the product bowl of a fluid bed granulator. A binder solution was prepared and sprayed into the granulator, and the mixture was dried. The resulting mixture was dry-blended with peppermint, spearmint, menthol, and eucalyptus such that the resulting composition contained 2.5 wt % peppermint, 5 wt % spearmint, 2.5 wt % menthol, and 2 wt % eucalyptus.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A smokeless tobacco product suitable for human consumption comprising powdered tobacco having a collective content of N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB) which is 0.3 μg/g or less;

wherein the powdered tobacco is formed from pulverized tobacco and consists essentially of Virginia flue cured tobacco; and wherein said pulverized tobacco is prepared from both tobacco lamina and tobacco stems.

2. The smokeless tobacco product of claim 1 wherein the powdered tobacco is a solid bit.

3. A smokeless tobacco product suitable for human consumption comprising a solid bit of powdered tobacco having a collective content of N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB) which is 0.3 μg/g or less;

wherein the powdered tobacco is formed from pulverized tobacco and consists essentially of Virginia flue cured tobacco; and wherein said pulverized tobacco is prepared essentially from tobacco lamina.

4. The smokeless tobacco product of claim 3 comprising from about 10% to about 80% powdered tobacco by weight.

5. The smokeless tobacco product of claim 4 which comprises from about 25% to about 55 wt % powdered tobacco by weight.

6. The smokeless tobacco product of claim 3 wherein said collective content of N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB) is 0.2 μg/g or less.

7. The smokeless tobacco product of claim 6 wherein said collective content of N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB) is 0.1 μg/g or less.

8. The smokeless tobacco product of claim 3, further comprising at least one component selected from the group consisting of a binder, a flavorant, a sweetener, a coloring agent, and a filler.

9. A smokeless tobacco product suitable for human consumption comprising powdered tobacco having a collective content of N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB) which is 0.3 μg/g or less;

wherein the powdered tobacco is formed from pulverized tobacco and consists essentially of Virginia flue cured tobacco; and wherein said pulverized tobacco is prepared essentially from tobacco stems.

10. The smokeless tobacco product of claim 9 wherein the powdered tobacco is a solid bit.

11. A smokeless tobacco product suitable for human consumption comprising powdered tobacco having a collective content of N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB) which is 0.3 μg/g or less;

wherein the powdered tobacco is formed from an extract of tobacco and consists essentially of Virginia flue cured tobacco.

12. The smokeless tobacco product of claim 11, wherein said extract is prepared from both tobacco lamina and tobacco stems.

13. The smokeless tobacco product of claim 11 wherein said extract is prepared essentially from tobacco lamina.

14. The smokeless tobacco product of claim 11 wherein said extract is prepared essentially from tobacco stems.

15. The smokeless tobacco product of claim 11 wherein the powdered tobacco is a solid bit.

16. A smokeless tobacco product suitable for human consumption comprising powdered tobacco and from about 0.5 to about 15 wt % peppermint, from about 0.5 to about 15 wt % spearmint, from about 0.5 to about 15 wt % menthol, and from about 0.5 to about 15 wt % eucalyptus.

17. The smokeless tobacco product of claim 16 which comprises from about 0.5 to about 10 wt % peppermint, from about 0.5 to about 10 wt % spearmint, from about 0.5 to about 10 wt % menthol, and from about 0.5 to about 10 wt % eucalyptus.

18. The smokeless tobacco product of claim 16, wherein said powdered tobacco has a collective content of N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB) which is 0.3 $\mu$g/g or less.

19. The smokeless tobacco product of claim 18 wherein said collective content of N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB) is 0.2 $\mu$g/g or less.

20. The smokeless tobacco product of claim 19 wherein said collective content of N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB) is 0.1 $\mu$g/g or less.

* * * * *